United States Patent [19]

Hodson

[11] 4,456,095

[45] Jun. 26, 1984

[54] LEVELLING DEVICE FOR LADDERS

[75] Inventor: Baden L. Hodson, Enoggera, Australia

[73] Assignee: Milba Properties Pty. Ltd., Enoggera, Australia

[21] Appl. No.: 406,244

[22] PCT Filed: Dec. 23, 1981

[86] PCT No.: PCT/AU81/00193

§ 371 Date: Aug. 3, 1982

§ 102(e) Date: Aug. 3, 1982

[87] PCT Pub. No.: WO82/02416

PCT Pub. Date: Jul. 22, 1982

[30] Foreign Application Priority Data

Jan. 2, 1981 [AU] Australia ..... PE7104

[51] Int. Cl.[3] ..... E06C 7/44

[52] U.S. Cl. ..... 182/200; 182/15; 248/188.3

[58] Field of Search ..... 182/200, 15; 248/188.3

[56] References Cited

U.S. PATENT DOCUMENTS

| | | | |
|---|---|---|---|
| 1,127,287 | 2/1915 | Sadler | 182/200 |
| 1,542,775 | 6/1925 | Husted | 182/202 |
| 1,928,158 | 9/1933 | Ruse | 182/200 |
| 2,289,499 | 7/1942 | Husted | 182/202 |
| 2,555,036 | 5/1951 | Husted | 182/202 |
| 2,835,427 | 5/1958 | Balcar | 182/202 |
| 2,960,182 | 11/1960 | Swanson | 182/200 |
| 2,971,602 | 2/1961 | West | 182/200 |

FOREIGN PATENT DOCUMENTS

| | | | |
|---|---|---|---|
| 655493 | 7/1951 | United Kingdom | 182/200 |

*Primary Examiner*—R. P. Machado

*Attorney, Agent, or Firm*—D. Paul Weaver

[57] ABSTRACT

A levelling device for ladders has a pair of locking bars (24, 32, 51, 52) pivotally mounted on the ladder (28, 31, 42). A support arc (16, 33, 48), having feet (19, 34) at each end, passes through apertures (50) in the locking bars (24, 33, 51, 52). Springs (25, 46) interconnecting each locking bar (24, 32, 51, 52) and the ladder (28, 31, 42) urge the locking bars (24, 32, 51, 52) to an unlocked position where the support arc (16, 33, 48) is free to pass through the apertures (50). When weight is applied to the ladder (28, 31, 42), the locking bars (24, 32, 51, 52) are urged to a locked position, against the springs (25, 46), where the sides of the apertures (50) engage the support arc (16, 33, 48) to lock it against further movement. By adjustment of the support arc (16, 33, 48), the feet (19, 34) may be raised or lowered to accommodate any irregularities in the support surface so that the ladder (28, 31, 42) will stand vertically.

The levelling device may also be applied to tables, chairs, trestles (42) or like articles.

6 Claims, 5 Drawing Figures

LEVELLING DEVICE FOR LADDERS

BACKGROUND OF THE INVENTION (1) Field of the Invention:

This invention relates to a levelling device for ladders and the like.

(2) Description of the Prior Art:

Difficulty is often experienced in providing a firm and level foundation for a ladder, trestle or the like which is required to be used on sloping ground. In these circumstances, it is usual to use blocks to support one leg of the ladder above the lower level of ground if the slope is not excessive, but in a case where the slope is such that the ladder when in its upright or working position, has one leg a considerable distance above the ground, the use of a sufficiently high block or assembly of block may be unreliable and very dangerous.

BRIEF SUMMARY OF THE INVENTION

The present invention has been devised with the general object of providing a levelling device by means of which a ladder (which term is hereinafter in the specification and claims to be taken to include a trestle, chair, table, legged or based object or other like article), may be firmly supported upon a sloping foundation or even upon two steps at different levels, for example, the device being quickly and easily adjustable to suit widely different requirements, and having means for automatically locking the levelling device in required/adjusted position.

With the foregoing and other objects in view, the invention resides broadly in a levelling device for a ladder including a frame transversely applicable to the lower part of the ladder; apertured locking members pivoted to the frame; and an arcuate member slidable through the locking members and terminating in feet for supporting the ladder; the locking members being pivotally tiltable under downward pressure of the frame to lock the arcuate member against slidable movement therethrough. The frame may be provided with a support for the uprights of a ladder and means for releasably securing the ladder uprights firmly to the frame; or alternatively the frame may be incorporated in the structure of the ladder and serve as a bottom rung therefor. The locking means are preferably spring-loaded to positions freeing the arcuate member for slidable movement therethrough, and enabling the ladder to be easily brought to upright safe working position despite the feet being at different levels. Other features of the invention will become apparent from the following description.

BRIEF DESCRIPTION OF THE SEVERAL VIEWS OF THE DRAWINGS

In order that the invention may be readily understood and carried into practical effect, reference is now made to the accompanying drawings, wherein.

DETAILED DESCRIPTION OF THE PREFERRED EMBODIMENTS

Figure 1:
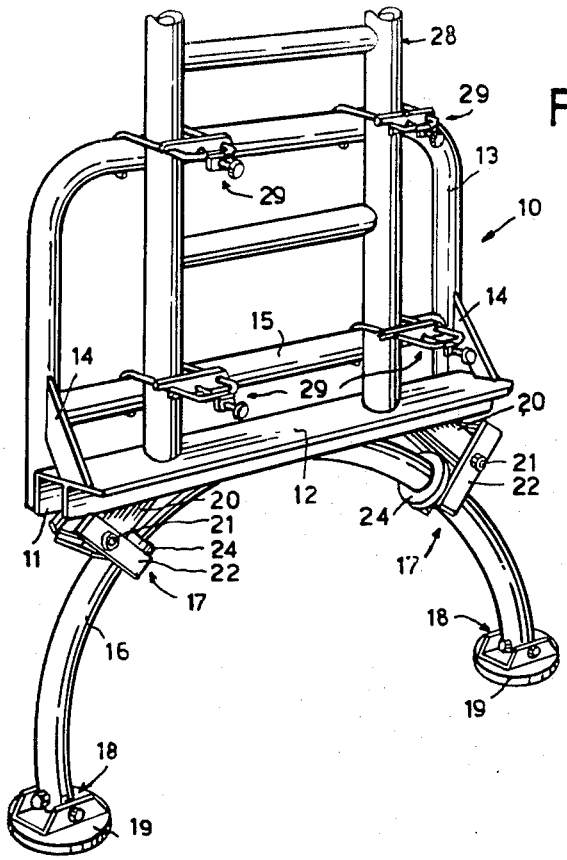
FIG. 1 is a perspective view of a levelling device according to the invention applied to a conventional ladder.
Figure 3:
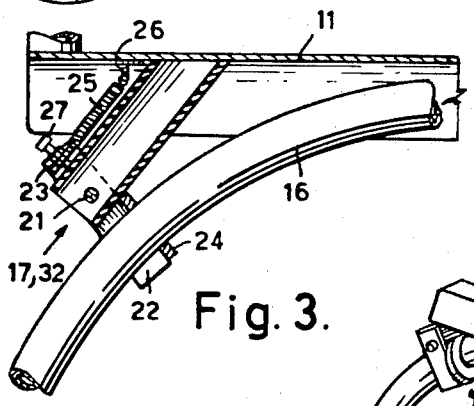
FIG. 3 is a sectional view of one of the automatic locking means of the levelling device.

Referring initially to FIGS. 1 and 3 of the drawings, a levelling device for a ladder, trestle or the like includes a mounting frame 10 having a transverse inverted channel 11 with its top member or web projected forwardly to form with the channel, a platform 12. The mounting frame also includes a tubular member of inverted U-shape forming an arch 13 the bottom ends of which are welded or otherwise rigidly secured to the sides of the channel 11, and braced gussets 14, the two sides of the arch being interconnected by a tubular cross-member 15.

A support arc 16, being a length of metal tube bent to substantially semi-circular form, passes closely through a pair of locking devices 17 at the sides of the channel 11 and midway between these locking devices the support arc is closely but slidably engaged in the middle part of the channel. The sides of the arc, which constitute support legs, are connected by universal joints at 18 to a pair of disc-shaped feet 19 preferably having soles (not shown) of tough resilient material formed with a ribbed or other non-skid under-surface.

Each of the locking devices, as shown more particularly in FIG. 3, includes a box-section carrier bracket 20 secured in, and extending obliquely below, the mounting frame channel 11. Pivoted to the lower part of the bracket 20 by a bolt 21 are two parallel arms 22 their upper parts being rigidly interconnected by a cross-piece 23. Welded or otherwise rigidly secured on the lower parts of the arms 22 is an annular lock plate 24 through which the support arc 16 passes closely. A pair of helical springs 25 are tensioned between the cross-piece 23 and an attachment bracket 26 within the channel 11. An adjustment screw 27 with lock nut, engaged in a tapped hole in the cross-piece 23, engages the carrier bracket 20 to limit the pivotal movement of the arms 22 and lock plate 24 by the action of the springs 25.

When, in each locking device 17, the lock plate 24 is pivoted to full extent by the tension springs 25, the support arc 16 will slide freely through the annular lock plates; but when the lock plates are tilted against the action of the springs 25, they will grip the support arc firmly and hold it against slidable movement.

A ladder 28 is fitted to the levelling device by standing it on the platform and securing its uprights to the top of the arch 13 and the cross-member 15 by means of any suitable clamps, as shown at 29. The platform 12 is sufficiently wide to support ladders and trestles of a wide range of sizes.

When the ladder is to be supported for use, the feet 19 are set on the ground and the ladder 28 is lifted slightly to take its weight from the levelling device. The ladder can then be moved to one side or the other to bring it to a safe and accurately upright position, the locking devices 17 passing slidably over the support arc 16, their lock plates 24 being retained in a non-locking position by the springs 25. When the ladder is appropriately adjusted, it is released so that its weight is taken by the levelling device, the channel 11 thereupon lowering slightly as the lock plates 24 tilt, against the action of the springs 25, to locking positions, firmly gripping the support arc 16.

Figure 2:
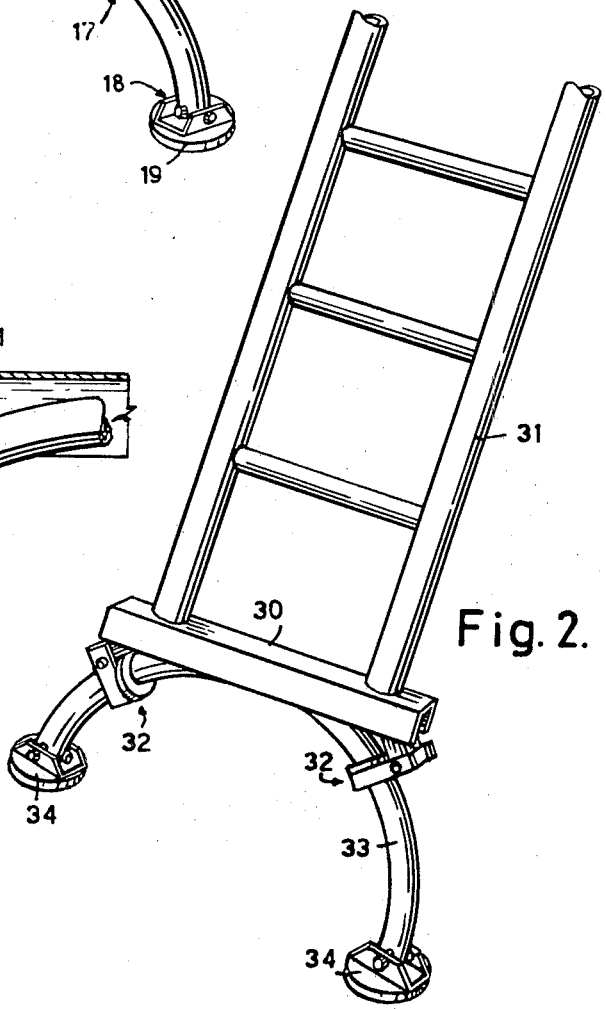
FIG. 2 is a perspective view of a levelling device incorporated in a ladder.

In the embodiment shown in FIG. 2, the inverted channel 30 is welded or otherwise fixed to the bottom ends of the uprights of a ladder 31, the channel forming the bottom rung of the ladder. Locking devices 32 as before described, at the sides of the channel 30, engage a support arc 33 with feet 34, all substantially as before described with reference to FIGS. 1 and 3.

Figure 4:
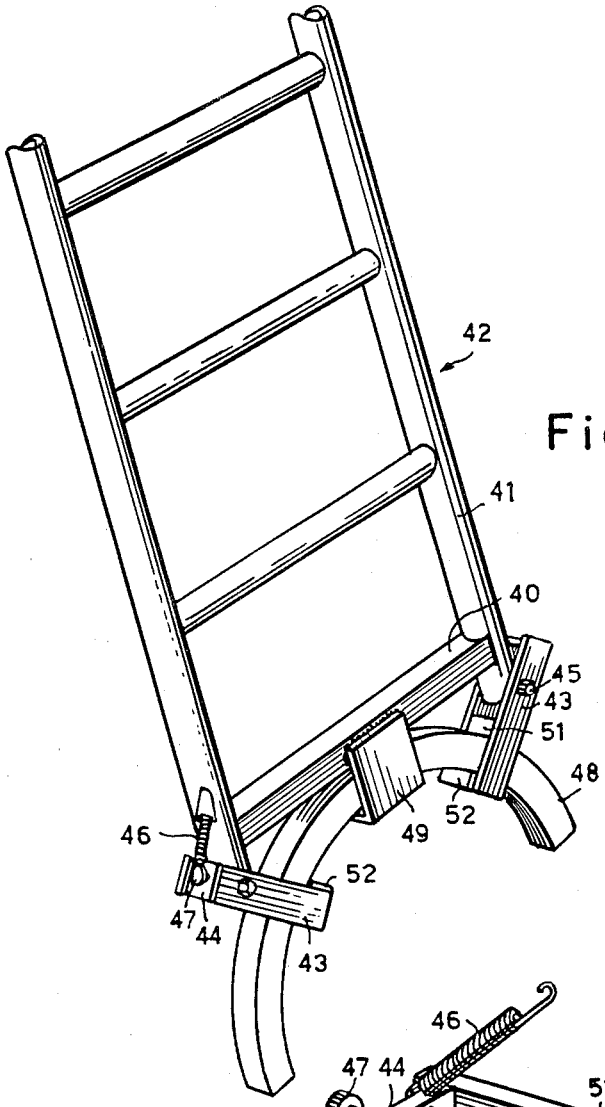
FIG. 4 is a perspective view of a levelling device incorporated in a trestle.
Figure 5:
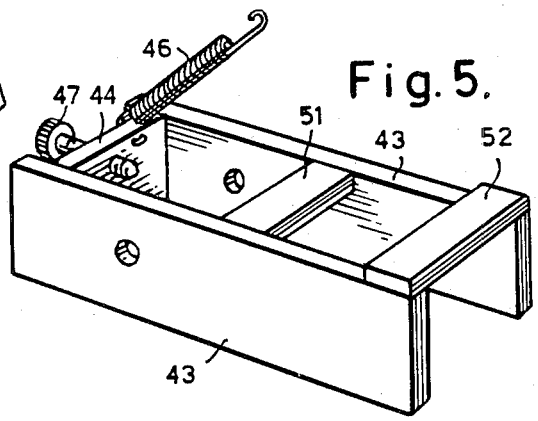
FIG. 5 is a perspective view of one of the automatic locking means of the levelling device of FIG. 4.

Referring now to the embodiment of FIGS. 4 and 5, a square-section ring 40 is welded or otherwise fixed to the bottom ends of the uprights 41 of a trestle 42. The locking devices have parallel arms 43, interconnected by a cross-piece 44, are pivotally mounted on each upright 41 by a bolt 45. A helical spring 46 is tensioned between the cross-piece 44 and the upright, while an adjustment nut 47, screwthreaded in the cross-piece 44, engages the upright 41 to limit the pivotal movement of the arms 43 by the spring 46.

The support arc 48, of square-section steel tube and fitted with feet (not shown), passes through a square loop 49 welded centrally on the underside of the bottom rung 40 and through the apertures 50 in the locking devices. The aperture 50 in each locking device is defined by upper and lower locking bars 51, 52 interconnecting the arms 43.

As shown in FIG. 5, the upper locking bar 52 is welded between the arms 43, while the lower locking bar 52 is welded to the side faces of the arms 43. As the upper and lower locking bars 51, 52 have differing axial offsets relative to the pivotal axis of the arms 43 (this axis being coincident with the bolt 45), the effective area of the aperture 50 is increased when the arms 43 are pivoted to full extent by the spring 46 (to enable the arc 48 to pass freely through the apertures); but when the arms 43 are tilted against the action of the spring, the locking bars 51, 52 grip the outer and inner faces, respectively, of the support arc 48 firmly and hold it against slidable movement.

Levelling devices according to the invention will be found to be very effective in achieving the objects for which they have been devised. It will, of course, be understood that the particular embodiments of the invention herein described and illustrated, may be subject to many modifications of constructional detail and design, which will be readily apparent to skilled persons, without departing from the scope of the invention hereinafter claimed.

I claim:

1. A levelling device for ladders comprising an arcuate support member having opposite ends adapted to engage a support surface, means attached to the lower portion of a ladder and adapting the ladder and arcuate support member for arcuate movement along the longitudinal axis of the arcuate support member, a pair of apertured locking members pivotally mounted on said means and receiving through the apertures thereof the arcuate support member, springs interconnecting said means and apertured locking members and biasing the latter on their pivot axes in a direction whereby the apertured locking members are released for relative movement along the axis of the arcuate support member, the placement of weight on said ladder overcoming the biasing force of said springs and moving the apertured locking members on their pivots to positions of positive locking with the arcuate support member, and adjustable stop means connected with the apertured locking members and preventing pivotal movement of the latter by said springs beyond the required released positions of the apertured locking members.

2. A levelling device for ladders as defined in claim 1, and the adjustable stop means comprising set screws having threaded engagement with the apertured locking members and being adjustable engageable with said means.

3. A levelling device for ladders as defined in claim 2, and said means comprising adapter frame means attached to the lower portion of the ladder.

4. A levelling device for ladders as defined in claim 1, and the apertured locking members comprising rigid gripping members.

5. A levelling device for ladders as defined in claim 3, and said springs comprising retractile coil springs connected between the apertured locking members and said adapter frame means on one side of the pivot axes of the apertured locking members.

6. A levelling device for ladders as defined in claim 4, and a pair of spaced locking bars on each pivoted locking member defining the aperture thereof which receives the arcuate support member, the upper locking bar adjacent to the pivot axis of the locking member having a reduced axial offset relative to the pivot axis and relative to the lower locking bar.

* * * * *